US005782308A

United States Patent [19]

Latten et al.

[11] Patent Number: 5,782,308

[45] Date of Patent: Jul. 21, 1998

[54] QUICK CLAMPING DEVICE FOR AT LEAST ONE TOOL OF A MACHINE TOOL

[75] Inventors: Werner Latten, Oerlinghausen; Hideji Saito, Düsseldorf, both of Germany

[73] Assignee: Amada GmbH, Haan, Germany

[21] Appl. No.: 764,224

[22] Filed: Dec. 13, 1996

[30] Foreign Application Priority Data

Dec. 15, 1995 [DE] Germany ..... 195 46 969.0

[51] Int. Cl.[6] ..... B21D 5/02

[52] U.S. Cl. ..... 72/481.6; 72/389.4; 72/482.6

[58] Field of Search ..... 72/389.4, 481.2, 72/481.6, 482.6, 481.1

[56] References Cited

FOREIGN PATENT DOCUMENTS

| | | | |
|---|---|---|---|
| 630699 | 12/1994 | European Pat. Off. | 72/481.6 |
| 630700 | 12/1994 | European Pat. Off. | 72/481.6 |
| 3524694 | 1/1987 | Germany | 72/389.4 |
| 405337553 | 12/1993 | Japan | 72/481.6 |
| 406142767 | 5/1994 | Japan | 72/481.6 |

*Primary Examiner*—David Jones

*Attorney, Agent, or Firm*—Laubscher & Laubscher

[57] ABSTRACT

The present invention refers to a quick clamping device for at least one tool of a machine tool, in particular for at least one bending or edging punch of a bending or edging press, comprising a clamping member and a safety and hold means for the tool, said clamping member being provided with an engagement strip which is pretensioned for engagement with a counterrecess on the tool shank and which is adapted to be actuated by a central operating member in a direction opposite to its pretension.

6 Claims, 3 Drawing Sheets

QUICK CLAMPING DEVICE FOR AT LEAST ONE TOOL OF A MACHINE TOOL

SPECIFICATION

1. Statement of the Invention

The present invention refers to a quick clamping device for at least one tool of a machine tool, in particular for at least one bending or edging punch of a bending or edging press, comprising a clamping member as a movable part of a tool holder for engagement with a tool shank, said clamping member being provided with a safety and hold means for inserting or removing the tool in an essentially vertical direction with regard to the tool holder.

2. Brief Description of the Prior Art

Tool-changing operations carried out in the case of metal-working machine tools, such as edging or bending presses, frequently entail certain difficulties, since a plurality of tools, in particular bending or edging punches, may possibly be held in one tool holder and since the tools often have a considerable weight. The tool holder is in most cases provided with a profile having horizontal projections which engage complementary counterprojections on the tool shank; this has the effect that such tools can be inserted in the tool holder as a top tool only from the side, i.e. in the direction of a working line, such as a bending or edging line. This necessitates in an disadvantageous manner not only comparatively difficult manipulations but also an adequate amount of lateral space adjacent the top tool of the machine.

For improving such clamping devices, it is therefore known to hold a bending or edging punch in a tool holder of the top tool only by lateral clamping pressure and to provide the clamping member at the same time with a safety and hold means which is resiliently pretensioned for engagement with complementary shaped elements on the tool shank so that, even if the clamping force is released, the tool will be prevented from falling out of the tool holder and can, in addition, also be inserted into the tool holder on the top tool from below against the pretension of-the safety and hold means (DE-A-31 36 450).

The above-mentioned device is, however, comparatively complicated and necessitates a separate, pivotable holding plate on the clamping device, said holding plate being additionally provided for fixing the safety and hold means at an out-of-engagement position.

SUMMARY OF THE INVENTION

It is the object of the present invention to facilitate the structural design of a quick clamping device of the type mentioned at the beginning as well as to improve said quick clamping device from the functional point of view.

In the case of the quick clamping device of the type mentioned at the beginning, this object is achieved by the features that the clamping member is provided with an engagement strip pretensioned for engagement with a counter-recess on the tool shank, in connection with a central operating member for the engagement strip on an outer side of the clamping member.

On the one hand, this solution prevents the tool from being acted upon by the safety and hold means only at individual, separate points thereof and, on the other hand, it provides, on the basis of a simple structural design of the operating member, preferably as a tilting lever, and by means of the engagement strip an efficient safety means over the total length of the tool or, at least, over comparatively large portions of the length thereof.

Preferably, the clamping member, which is adapted to be brought into clamping engagement with a quick clamping lever against a tool shank, in particular a tool shank of a bending or edging punch, is defined by a pivotably supported clamping plate, which is constructed like a clamping claw and which is supported such that it is pivotable about an axis extending parallel to the tool, said clamping plate being suitable for holding a plurality of tools in the tool holder.

Preferably, the upper part of the machine supports a sequence of several clamping plates of this type.

According to a further preferred embodiment of the present invention, the clamping member is held by a pivot bearing, which is defined by locking screws, on a stationary part of the tool holder such that it extends essentially parallel to said tool holder, and the engagement strip is provided for loose engagement with a groove of the tool shank of a bending or edging punch, said engagement being undetachable as long as the operating member is not actuated.

The preferred embodiment of the present invention is advantageous insofar as the whole clamping plate, especially also in the area supporting the engagement strip, can be provided with an extremely narrow structural design so that very acute bending angles can be achieved in the case of which the workpiece (metal sheet or plate) move upwards towards the bending tool.

In accordance with a further preferred embodiment of the present invention, a resilient pretensioning means, preferably in the form of a projecting pretensioning strip of elastomeric material, such as rubber, is provided between the pivot bearing of the clamping plate and the engagement strip, for backlash compensation, especially for jointly holding a plurality of tools by one common clamping plate.

Further preferred embodiments are disclosed in the rest of the subclaims.

BRIEF DESCRIPTION OF THE DRAWING

In the following, the present invention will be explained in detail on the basis of one embodiment and the associated drawings, in which.

Line 4—4 of FIG. 1 shows a sectional view of a tool holder provided with a quick clamping device and constituting part of a bending or edging press (without tool).

DETAILED DESCRIPTION

In the following, one embodiment of a quick clamping device will be explained, said quick clamping device being provided for clamping a bending punch as top tool of a bending press.

Figure 1:
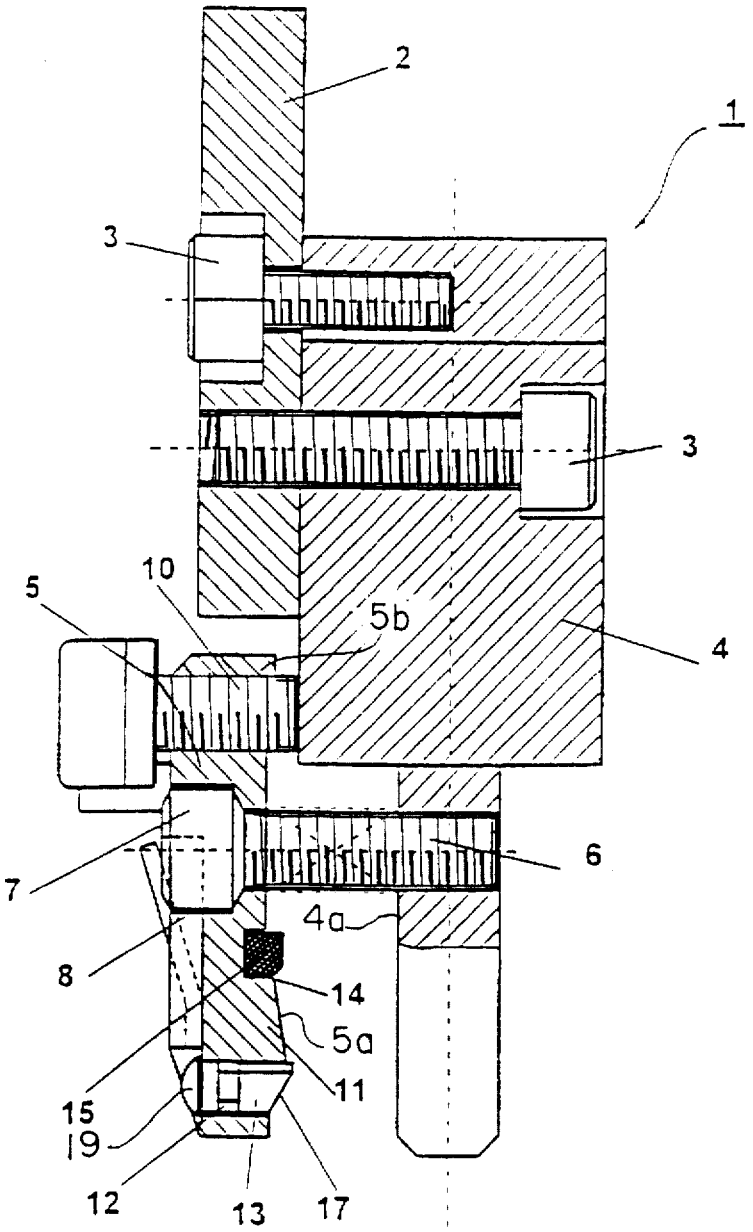
Figure 2:
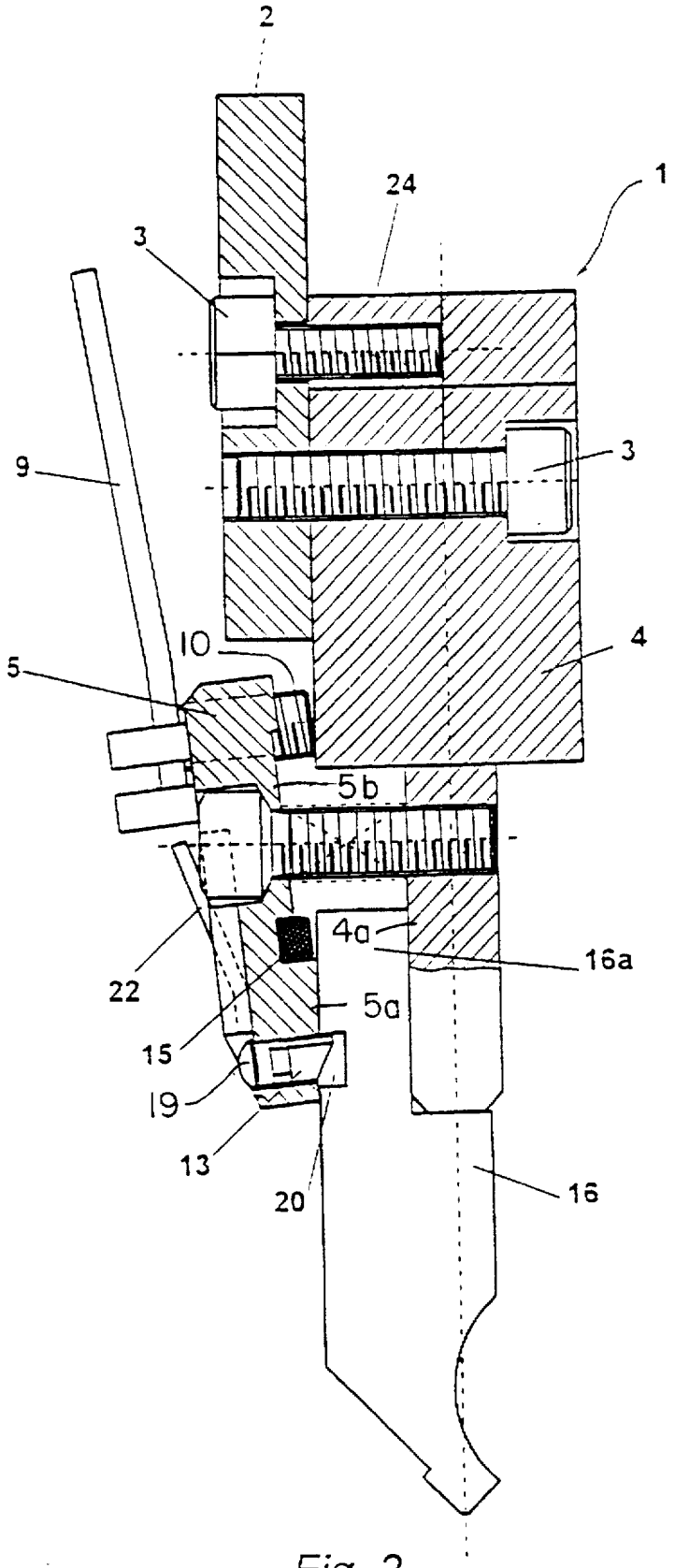
FIG. 2 shows the tool holder according to FIG. 1 having a bending punch inserted therein, said bending punch being clamped in the tool holder by means of the quick clamping device.
Figure 3:
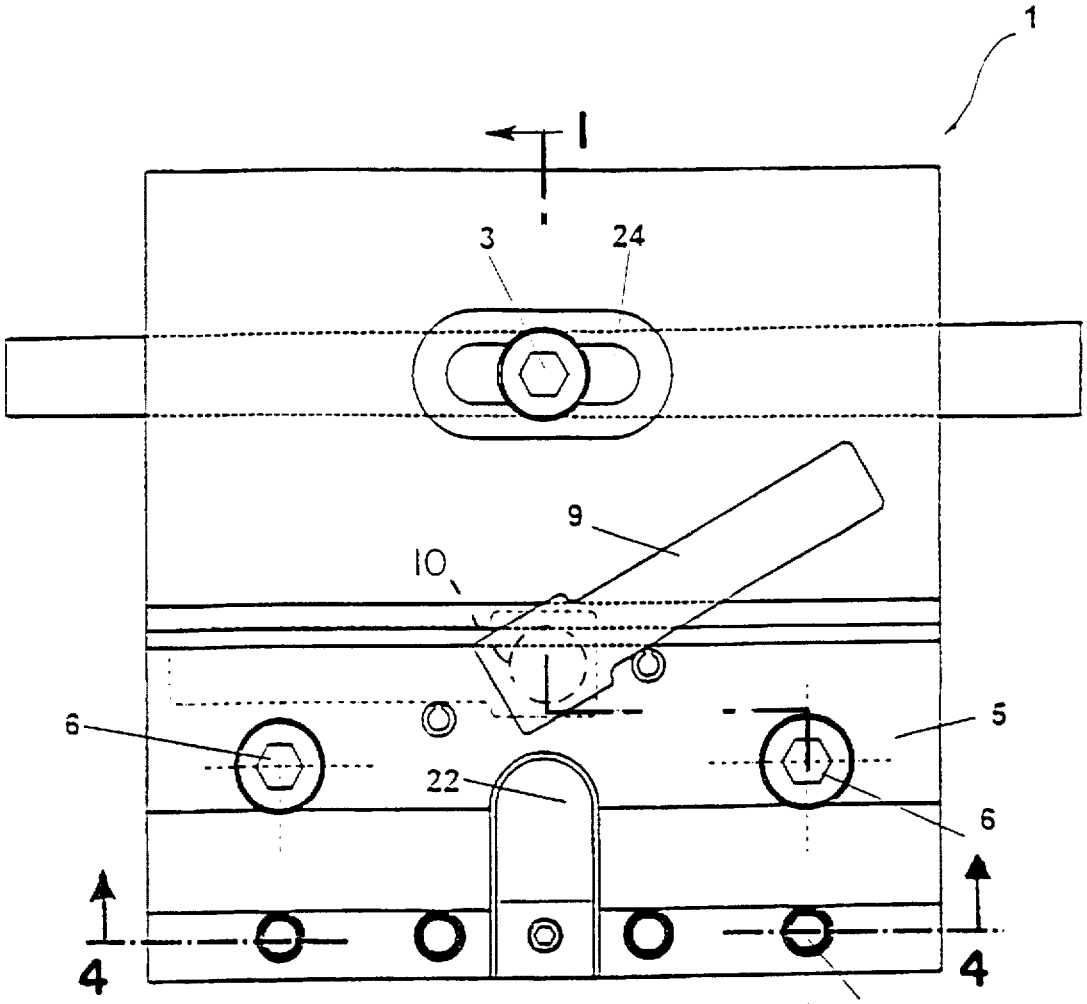
FIG. 3 shows a top view of a clamping plate of the quick clamping device according to FIG. 1 and 2.
Figure 4:
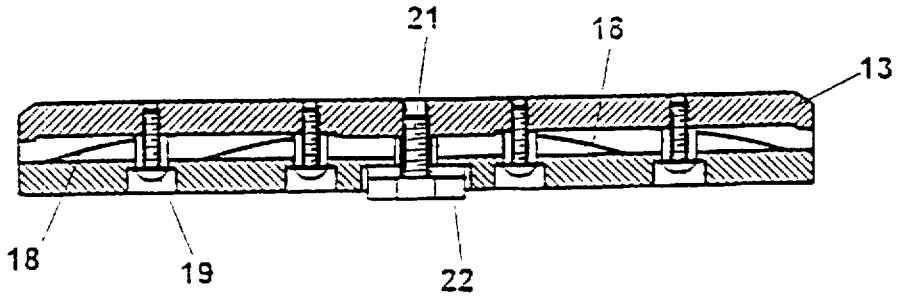
FIG. 4 shows a sectional view taken along line 4—4 of FIG. 3.

Whereas FIGS. 1 and 2 explain the quick clamping device without and with inserted (clamped) bending punch, FIGS. 3 and 4 refer to the actual clamping member, viz. a clamping plate.

The tool holder 1 is received in the upper part of a bending press in a manner which is not shown in detail in the present connection; this is roughly shown by a fixing piece 2, which has secured thereto the tool holder 1 by means of screws 3, in said FIGS. 1 and 2.

The tool holder 1 consists of a stationary tool holding member 4 having a clamping surface (4*a*) and of a movable tool holding member constructed as a quick clamping device, said movable tool holding member being here defined by a clamping plate 5, which is constructed like a clamping claw and which is pivotably mounted on the stationary tool holding member 4 via a pair of locking screws 6, as is clearly shown in FIG. 2 for the clamped condition.

For this purpose, the head 7 of the respective locking screw 6 defines a pivot bearing in combination with a bearing recess 8 of the clamping plate 5, and, consequently, said head is received in said bearing recess 8 with a certain amount of play. On one side of the clamping plate pivot axis, which is defined by the locking screws 6, a quick clamping lever 9 is in threaded engagement with a second portion (5*b*) of the clamping plate 5, said quick clamping lever 9 resting on the stationary tool holding member 4 via a threaded member 10 and applying the clamping force in connection with the locking screws 6 as abutment.

The clamping element located on a first portion (5*a*) of the clamping plate 5 preferably consists of an inclined clamping surface 11 delimited on one side thereof by a recess 12 in which a pretensioned engagement strip 13 is accommodated such that it projects from said recess 12 and is adapted to slide therein, and on the other side thereof by a stepped portion 14 used for holding and accommodating a resilient strip of material 15, which is particularly suitable for transmitting the clamping pressure to a plurality of bending punches 16, which can jointly be clamped by such a clamping plate 5 and the tool shank dimensions of which may differ, such that it is uniformly applied thereto.

As is shown more precisely also in connection with FIGS. 3 and 4, the engagement strip 13, provided with an insertion bevel 17 FIG. 1 so as to facilitate insertion of the bending punch 16 from below into the tool holder 1, is pretensioned by a plurality of leaf springs 18 in the direction of engagement, a plurality of locking screws 19 being used for holding the engagement strip 13, said locking screws being simultaneously used for fastening the individual pretensioning springs 18 between a groove base of recess 12 and the engagement strip 13 (cf. FIG. 4).

The engagement strip 13 is additionally connected via a screw 21 to an angled operational tilting lever 22 at the centre thereof, said operational tilting lever 22 being received in an upper recess of the clamping plate 5, so that, when said operational tilting lever 22 is pushed with one hand, the engagement strip 13 will be returned into the recess 12 against the force exerted by the leaf springs 18 so that, when the quick clamping lever 9 has been released, the clamped bending punch 16 will be disengaged from the tool holder 1, whereupon it can be removed from said tool holder 1 vertically downwards.

When the clamping plate 5 has been released and the engagement strip 13 actuated (withdrawn), the residual pressure (for releasing the clamping plate 5, the formation of a gap of a few 1/100 mm relative to the tool shank will suffice) can just be sufficient for holding narrow tools. This permits the operator to choose among a plurality of tools, which can be clamped in common by the clamping plate 5, the desired one and remove it.

For engaging the engagement strip 13, the tool shank 16*a* of the bending punch 16 is provided with an adequate engagement groove 20.

Taking as a basis the condition according to FIG. 1, the bending punch can thus first be received loosely but undetachably in the tool holder 1 such that the engagement strip 13 lockingly engages the reception groove 20 of the tool shank 16*a* of said bending punch 16, and then it can be clamped via the quick clamping lever 9 by means of the clamping plate 5. When the bending punch 16 is being exchanged, the quick clamping lever 9 is again released by a quarter turn, whereupon the bending punch 16 will still be held loosely in the tool holder 1 by means of the engagement strip 13. Removal of the bending punch 16 will not be possible until the operational tilting lever 22 has been pushed once more. A very simple safety means preventing the bending punch 16 from being released unintentionally from the tool holder after release of the clamping device (defined by the clamping plate 5 and its pivotal movement caused the clamping lever 9) is provided in this way, said safety means facilitating tool-changing operations, especially in the case of bending or edging presses, to an essential extent.

Via an adjustment means comprising a screw 3 and an elongated hole 24 in the upper part of the stationary tool holding member 4, also the lateral position of the whole upper tool clamping means can be adjusted.

The quick clamping device is also particularly advantageous in view of the fact that it can be used in connection with normal standard tools so that it is also possible to retrofit machines which are already in operation with the clamping device, i.e. essentially with the clamping plate 5.

We claim:

1. A quick clamping device for securing a machine tool to a tool holder, comprising:

(a) a tool holder (4) having a clamping surface (4*a*);

(b) a clamping plate (5) connected with said tool holder for pivotal movement about an axis parallel with, opposite, and spaced from said clamping surface, said clamping plate being pivotable between a released tool-receiving position generally parallel with and spaced from said clamping surface, and an inclined clamping position in which first (5*a*) and second (5*b*) portions of said clamping member are adjacent and spaced from said clamping surface, respectively;

(c) quick release means (9, 10) for pivoting said clamping plate between said released and clamping positions, respectively, whereby when said clamping plate is in said released position and a machine tool is inserted between said clamping plate and said clamping surface, said quick release means is operable to pivot said clamping member toward said clamping position, thereby to clamp the tool to said clamping surface; and (d) safety holding means (13, 17) for retaining the machine tool in a space between said clamping member and said clamping surface when said clamping member is pivoted by said quick release means toward said released position, said safety holding means including:

(1) a retaining member (13) mounted for movement in a corresponding recess (12) contained in the face of said clamping plate first portion for movement between extended and retracted positions relative to said clamping plate;

(2) resilient means (18) normally biasing said retaining member toward said extended position, thereby to cause the retaining member to extend with a corresponding groove (20) contained within the machine tool; and (3) safety release lever means (22) for displacing said retaining member toward said retracted position, thereby to release said machine tool for removal from said space.

2. A quick clamping device as defined in claim 1, wherein said clamping plate is pivotally connected with said tool holder by a pivot bearing (7).

3. A quick clamping device as defined in claim 2, wherein said pivot bearing (7) comprises two locking screws (6), said screws passing through corresponding recesses (8) contained in said clamping plate between said first and second portions and on opposite sides of said safety release lever means.

4. A quick clamping device as defined in claim 2, wherein said clamping plate (5) further comprises a resilient member (15) mounted in a corresponding recess contained in the face of said clamping plate between said retaining member (13) and said pivot bearing (7), thereby to transmit clamping pressure to machine tools having shanks of differing dimensions.

5. A quick clamping device as defined in claim 4, wherein said resilient member (15) is formed from an elastomeric material.

6. A quick clamping device as defined in claim 1, wherein one end of said retaining member (13) extends from said recess and includes an insertion bevel (17) for facilitating insertion of said retaining member into the machine tool groove.

* * * * *